US009428917B2

(12) United States Patent
Rodler

(10) Patent No.: US 9,428,917 B2
(45) Date of Patent: Aug. 30, 2016

(54) COMBINATION EXPANSION JOINT STRIP

(71) Applicant: Micah Rodler, Santa Cruz, CA (US)

(72) Inventor: Micah Rodler, Santa Cruz, CA (US)

( * ) Notice: Subject to any disclaimer, the term of this patent is extended or adjusted under 35 U.S.C. 154(b) by 0 days.

(21) Appl. No.: 14/875,138

(22) Filed: Oct. 5, 2015

(65) Prior Publication Data

US 2016/0097203 A1 Apr. 7, 2016

Related U.S. Application Data

(60) Provisional application No. 62/059,635, filed on Oct. 3, 2014.

(51) Int. Cl.

| | |
|---|---|
| ***E04B 1/62*** | (2006.01) |
| ***E04F 13/06*** | (2006.01) |
| ***E06B 1/62*** | (2006.01) |
| ***E04G 21/30*** | (2006.01) |

(52) U.S. Cl.

CPC ..... *E04F 13/06* (2013.01); *E04G 21/30* (2013.01); *E06B 1/62* (2013.01); *E04F 2013/063* (2013.01)

(58) Field of Classification Search

CPC . E04F 13/06; E04F 13/068; E04F 2013/063; E06B 1/62; E04G 21/30

USPC ..... 52/393, 364, 365, 366, 371, 287.1

See application file for complete search history.

(56) References Cited

U.S. PATENT DOCUMENTS

| | | | | |
|---|---|---|---|---|
| 3,807,107 A | | 4/1974 | Davis | |
| 4,023,324 A | | 5/1977 | Majeske | |
| 4,977,718 A | * | 12/1990 | Hoffman, Sr. | E04F 13/06 52/287.1 |
| 5,091,235 A | * | 2/1992 | Vergnano | B32B 5/26 428/131 |
| 6,418,688 B1 | | 7/2002 | Jones, Jr. | |
| 6,745,531 B1 | * | 6/2004 | Egan | E04B 1/70 52/302.1 |
| 6,993,874 B2 | | 2/2006 | Trout | |
| 7,673,428 B1 | * | 3/2010 | Smythe | E04F 13/06 52/255 |
| 7,861,486 B2 | * | 1/2011 | Hopkins | E04F 15/14 29/458 |
| 2002/0124504 A1 | * | 9/2002 | Maylon | E04F 13/06 52/318 |
| 2005/0066600 A1 | * | 3/2005 | Moulton | E04B 1/6813 52/393 |
| 2005/0252131 A1 | * | 11/2005 | Bushberger | E06B 1/62 52/411 |
| 2006/0283115 A1 | * | 12/2006 | Robertson | B29C 66/304 52/364 |
| 2013/0255165 A1 | * | 10/2013 | Rutherford | E04B 1/64 52/58 |
| 2014/0096464 A1 | * | 4/2014 | Rosenthal | E04F 13/06 52/287.1 |
| 2014/0123581 A1 | * | 5/2014 | Ward | E04F 13/068 52/287.1 |

* cited by examiner

*Primary Examiner* — Basil Katcheves

(74) *Attorney, Agent, or Firm* — Robert Blumberg

(57) ABSTRACT

Provided is an improved multi-function expansion joint filler which combines the functions of building element spacer, surface finishing screed, masking attachment tape, sealant groove creation, and sealant groove backing material into a single strip for simplified sealing of building cladding joints, intersections or wall penetrations such as windows, doors, or other exterior facade penetration.

6 Claims, 5 Drawing Sheets

COMBINATION EXPANSION JOINT STRIP

REFERENCES CITED

U.S. Pat. No. 6,418,688 Joint Forming Systems
U.S. Pat. No. 4,023,324 Method for Making Expansion Joints for Roads and Buildings
U.S. Pat. No. 3,807,107 Closure Spacer Member and Method of Erecting a Fixed Frame Assembly
U.S. Pat. No. 6,993,874B2 Joint Materials and Configurations

CROSS-REFERENCE TO RELATED APPLICATIONS

This application claims an invention which was disclosed in U.S. Provisional Application No. 62/059,635, filed 3 Oct. 2014, entitled "Combination Expansion Joint Strip with Strippable Screed Spacer, Masking Attachment, and Sealant Joint Backing Material". The benefit under 35 USC §119(e) of the United States provisional application is hereby claimed, and the aforementioned application is hereby incorporated herein by reference.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The primary field of application of the subject matter is the construction of water seal expansion joints at building fenestrations or penetrations.

During building construction or remodeling, forming an effective and code-compliant water seal around wall penetrations such as window and door frames, pipes, exterior trim, or vents, requires accommodation for the differential thermal and hygroscopic expansion between adjoining materials. Such joints frequently suffer from water intrusion resulting in structure damage because inadequate methods and materials are used in order to save labor and material cost. While effective code-compliant methods and materials are available, they are expensive and time consuming to install.

The currently accepted practice for proper joining of stucco or similar wall finish coats, hereafter referred to as stucco, to a wall penetration, hereafter exemplified by a window, uses at least 5 steps:

a) Spacing: A screed strip sometimes called casing bead is attached to the wall around the window to form a gap between the stucco and the window when the stucco is later applied up to the Casing Bead.
b) Masking: The window is then masked with masking tape and a covering material such as plastic or paper to protect it during stucco application.
c) Screeding: The stucco is applied up to the casing bead, using the outer surface of the casing bead as a screed to control the depth of the stucco. Mechanical removal is required for any stucco which has gotten into the groove between the casing bead and the widow frame, as the masking does not cover the groove.
d) Sealant Backing: A compressible strip usually called backer rod is forced into the gap between the casing bead and the window frame to partially fill the gap and thereby reduce the amount of sealant needed to fill the gap, and to prevent adhesion of the sealant to a third rigid surface at the bottom of the gap, as such third surface adhesion would detrimentally affect the performance of the sealant in stretching and compressing with relative movement of the window and stucco.
e) Sealant Application: The remaining gap is filled with a sealant, sometimes called caulking material, and the masking materials are removed.

Though such separation between stucco and other materials is a building code requirement, due to the number of materials and labor steps involved, many windows, doors, and other wall penetrations are installed without proper use of this process and these materials and subsequent water damage occurs due to cracks resulting from differential thermal and hygroscopic expansion of the stucco and the other materials in the structure.

There is a need for a product and method which saves material and labor cost to perform the described process.

Previous devices with related purposes are described in U.S. Pat. Nos. 6,418,688, 4,023,324, 3,807,107 and 6,993,874B2, but none use adhesive attachment needed in construction applications or assist in the attachment of masking material.

U.S. Pat. No. 6,993,874B2 provides for Spacing, Screeding, and Sealant Backing, by use of an adhesively applied two part strip, the top part of which is removed after use as a screed for the stucco, but fails to provide any assistance for the masking process and requires an unnecessary and costly convex internal interface.

The subject invention satisfies the described need including Spacing, Screeding, Masking attachment assistance, and Sealant Backing all in a single application with inexpensive materials.

BRIEF SUMMARY OF THE INVENTION

While the invention may be embodied in different forms, the descriptions and illustrations herein of specific preferred embodiments are exemplifications of the principles of the invention and are not intended to limit the scope of the Invention to any particular embodiments described or illustrated.

The subject item, referred to as Combination Expansion Joint Strip, with strippable screed spacer, masking attachment surface, and sealant joint backing material, hereinafter referred to as the Invention, is a device suitable for performing the steps of Spacing, Masking, Screeding, and Sealant Backing as described in the BACKGROUND OF THE INVENTION section using layers of inexpensive strip materials combined in a single assembly for application around any wall penetration such as a window.

In one embodiment, the Invention comprises a double sided adhesive tape, an elongate flexible and compressible member such as a cellular foam strip, hereafter referred to as a compressible strip, and removable adhesive resistant strips, referred to hereafter as liners, to prevent the adhesive from inconveniently sticking to unintended surfaces before use. The assembly of these elements is slit almost completely through so that by tearing out the upper portion it can be divided into a lower portion which remains between the stucco and the window to permanently separate them and to serve as a backing material for sealant, and an upper portion which can be removed after it is used both as a means of attaching protective masking covering nearby areas and as a screed to level an adjacent formable building surface coating such as stucco, while forming a gap for receiving a sealant. In the preferred embodiment, the removable liners are extended beyond the adhesive surfaces they cover to present an easily gripped area for stripping them off. These elements of the Invention are incorporated into a single layered assembly, and are applied in a single operation to reduce labor costs.

The principle characteristics and features of the Invention will be more readily understood from the following descriptions taken in connection with the accompanying drawings forming a part hereof.

DETAILED DESCRIPTION OF THE FIGURES

Figure 1:
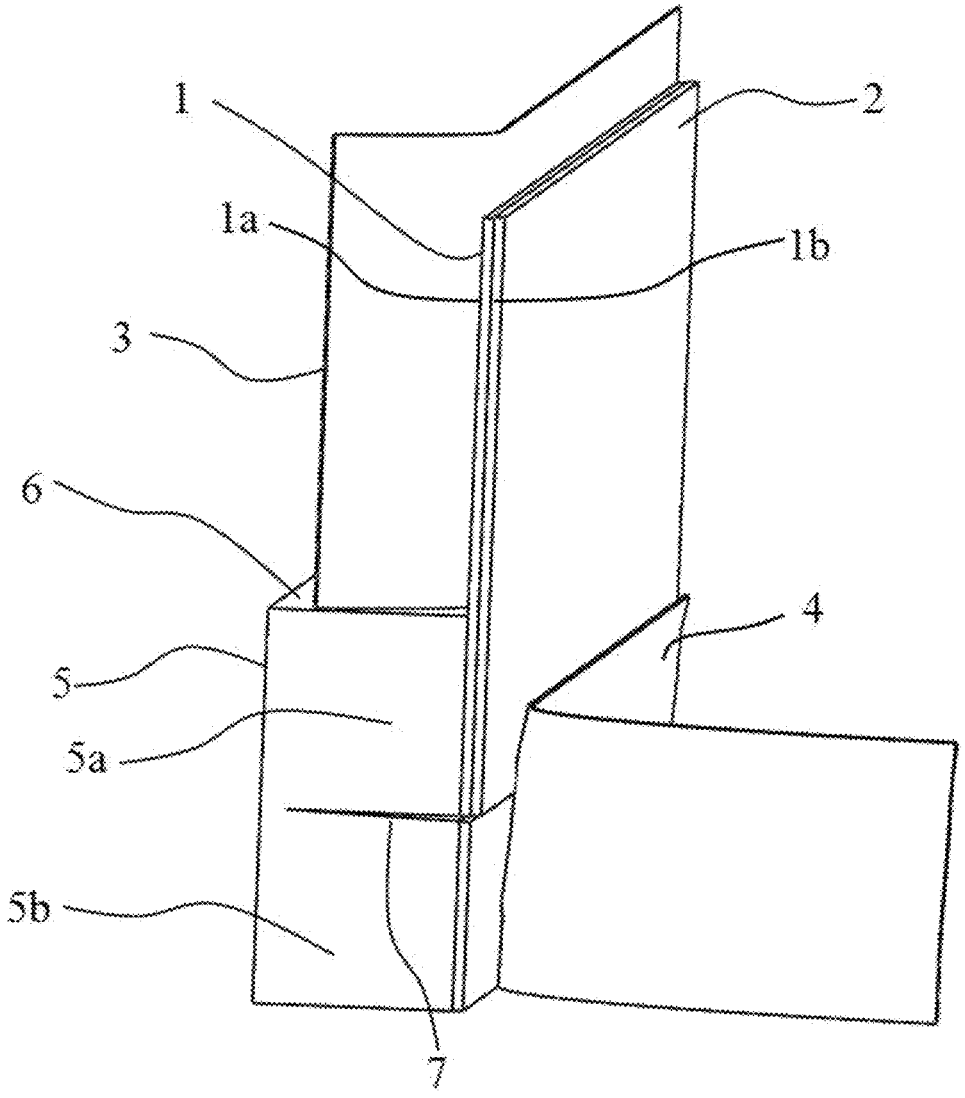
FIG. 1 is a section view of the layered assembly of the Invention revealing the multiple component layers and functional surfaces.

FIG. 1 shows an oblique end view of the layered construction of the Invention. A double sided Adhesive Tape Strip 1 is shown with a Front Surface 1*a* disposed to the left of the figure and an opposite Back Surface 1*b* disposed to the right of the figure. A Compressible Strip 5 is shown permanently adhered to Front Surface 1*a* substantially adjacent to the edge of Adhesive Tape Strip 1 closest to the bottom in FIG. 1. A Front Side Tape Liner 3, being an adhesive resistant material, is shown temporarily adhered to Front Surface 1*a* substantially covering the remaining portion of Front Surface 1*a* not covered by Compressible Strip 5 and, in this embodiment of the invention, is shown overhanging the upper edge of Adhesive Tape Strip 1, although such overhang is not a requirement of the invention. Front Side Tape Liner 3 is shown partially peeled back for clarity, but will normally remain adhered to Front Surface 1*a* until it is removed during use as shown in a later figure. A Slit 7 penetrates completely through Adhesive Tape Strip 1 and substantially through Compressible Strip 5, forming a Compressible Strip Upper Portion 5*a* to be separable from a Compressible Strip Lower Portion 5*b* by tearing the remaining compressible material still connecting Compressible Strip Upper Portion 5*a* to Compressible Strip Lower Portion 5*b* at the tip of Slit 7. Slit 7 may be an intermittent full-depth perforation strip, or a partially penetrating slit from opposite sides, instead of a continuous partial penetration slit as shown. A Back Side Tape Liner Upper Portion 2 is adhered to Back Surface 1*b*, substantially covering the portion of Back Surface 1*b* above Slit 7. A Back Side Tape Liner Lower Portion 4, being an adhesive resistant material, is temporarily adhered to the lower portion of Back Surface 1*b* below Slit 7, and is shown in this embodiment also overlaying Slit 7 and a portion of Back Side Tape Liner Upper Portion 2 such that it is easily gripped for removal. This extension of Back Side Tape Liner Lower Portion 4 beyond Slit 7 is not a requirement of the Invention but is convenient for gripping Back Side Tape Liner Lower Portion 4 for easy removal and is therefore shown in this preferred embodiment of the Invention. A Screed Surface 6 disposed on the upward surface of Compressible Strip 5 is indicated. Screed Surface 6 is shown in its appropriate position to help control the thickness of subsequently applied stucco.

Figure 2:
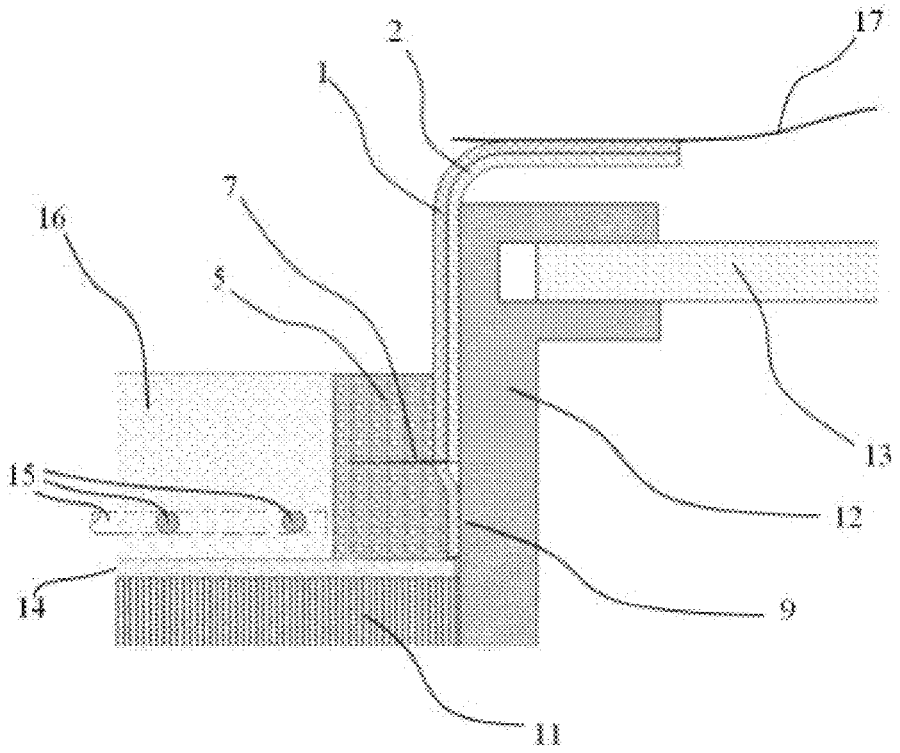
FIG. 2 is a section view of the layered assembly of the Invention showing it's positional relationship with window and wall elements.

FIG. 2 depicts a section view of the Invention in use in a window-to-wall joint construction looking downward with the building exterior at the top of the figure and the building interior at the bottom of the figure. In this figure, a Wall 11 is penetrated by a Window Frame 12, with a Window Glass 13 shown mounted in Window Frame 12 merely to clarify the orientation of the window assembly in the wall. Window Glass 13 may represent any manner of window glass configuration. A conventional commercial Water Barrier Material 14 is shown affixed to Wall 11 and a conventional commercial Wire Reinforcing Mesh 15 is shown in position spaced a short distance from Water Barrier Material 14 and thus substantially buried in a conventional commercial Stucco 16. Stucco 16 is shown adhered to Water Barrier 14, Wire Reinforcing Mesh 15, and Compressible Strip 5, the latter being a component of the Invention. Adhesive Tape Strip 1 and Back Side Tape Liner 2 are shown folded over the outside of Window Frame 12, with a Masking Material 17 attached to Adhesive Tape Strip 1 to substantially protect Window Frame 12 and Window Glass 13 from residue during the application of Stucco 16. Back Side Tape Liner Lower Portion 4 seen in FIG. 1 is not shown in FIG. 2, having been removed to enable adhering Adhesive Tape Strip 1 to Window Frame 12 at indicated region 9. Front Side Tape Liner 3 seen in FIG. 1 is not shown in FIG. 2, having been removed to enable adhering Masking Material 17 to Adhesive Tape Strip 1. Typically, construction uses elements such as Water Barrier Material 14, Wire Reinforcing Mesh 15, Wall 11, Window Frame 12, Window Glass 13, and Stucco 16. The Invention is designed to work in conjunction with these elements but does not require their use. Further, these elements are typically available as commercial products and are not included in the Invention.

Figure 3:
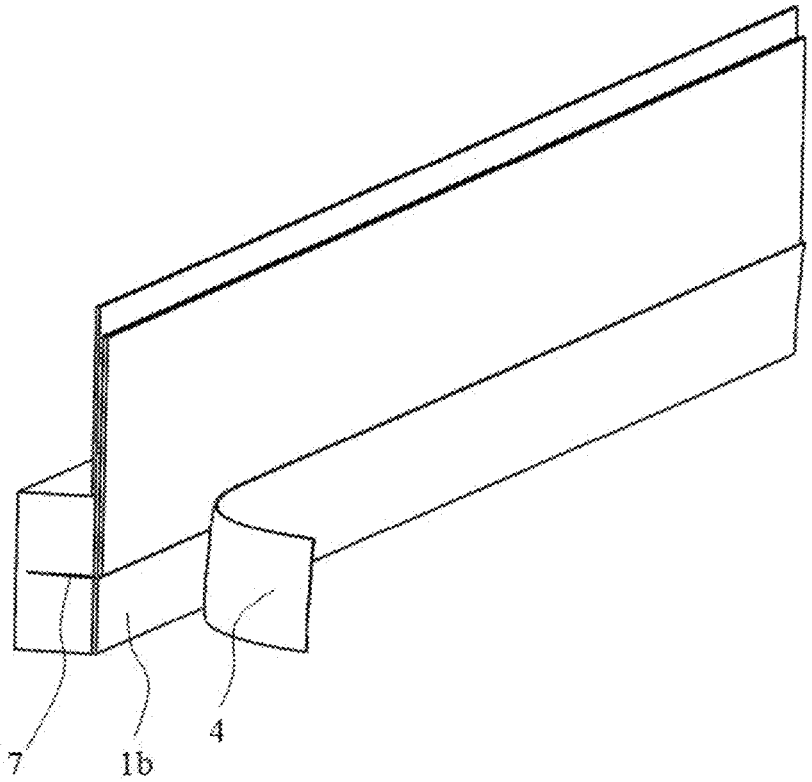
FIG. 3 shows the Invention with a liner partially removed for adhesive attachment to the outer surface of wall penetration.

FIG. 3 shows Back Side Tape Liner Lower Portion 4 partially peeled off Adhesive Tape Strip 1 to reveal the portion of Back Surface 1*b* below Slit 7. Upon removal of Back Side Tape Liner Lower Portion 4, the Invention is ready to be adhered to a building wall penetrating element such as a window by adhesion of Back Surface 1*b* below Slit 7 to the outer surface of such a wall penetrating element.

Figure 4:
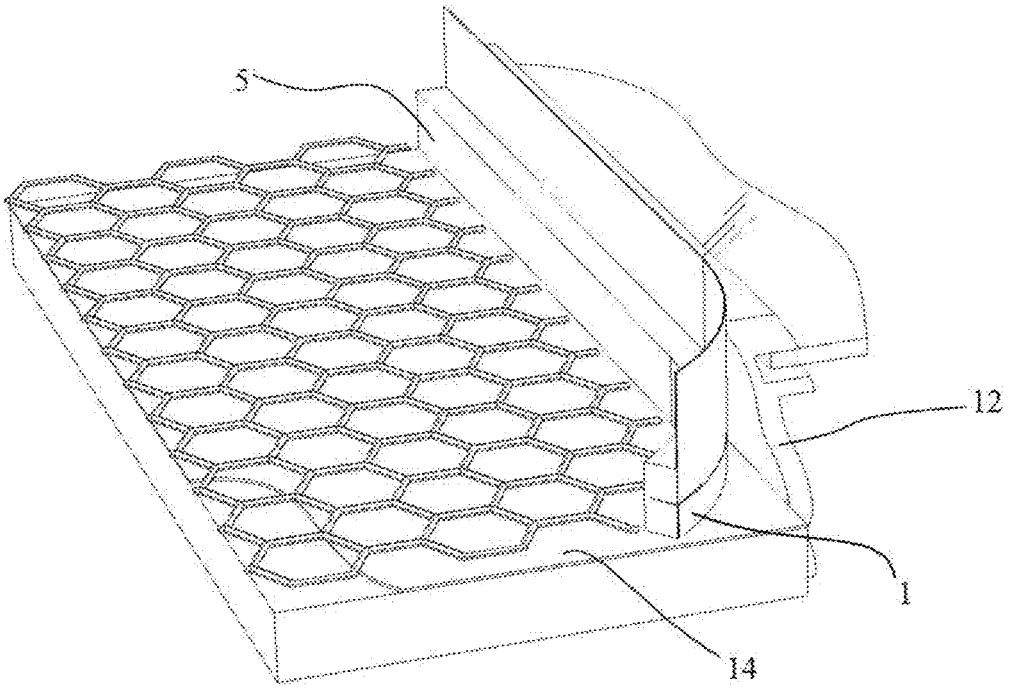
FIG. 4 shows the Invention in the process of being attached to a window frame.

FIG. 4 shows the Invention being mounted by adhering Adhesive Tape Strip 1 to Window Frame 12 while positioning the Invention adjacent to Water Barrier 14.

Figure 5:
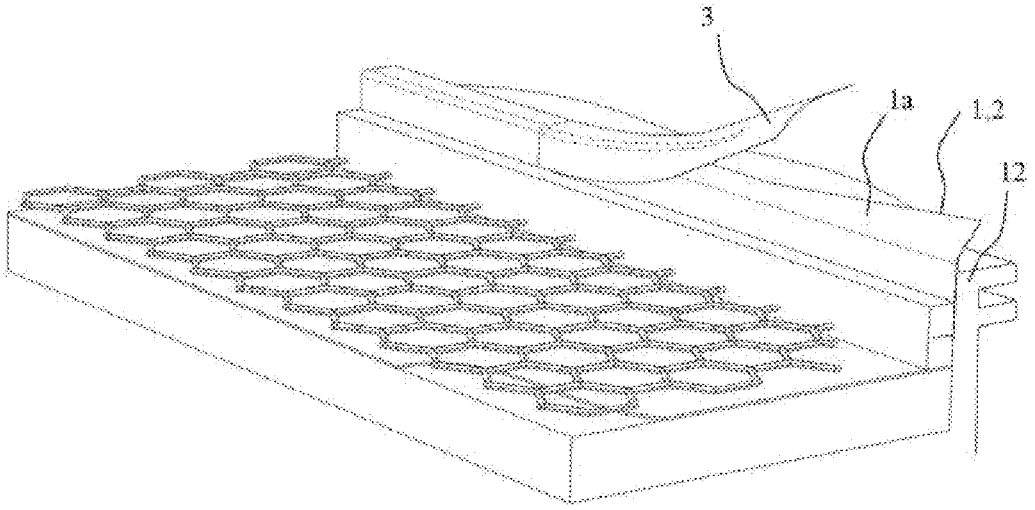
FIG. 5 shows the invention installed and partially prepared for use in attaching window masking material.

FIG. 5 shows Adhesive Tape Strip 1 and Back Side Tape Liner Upper Portion 2 being folded over the outer surface of Window Frame 12, and Front Side Tape Liner 3 being peeled from Front Surface 1*a* of Adhesive Tape Strip 1 to expose adhesive on Front Surface 1*a*.

Figure 6:
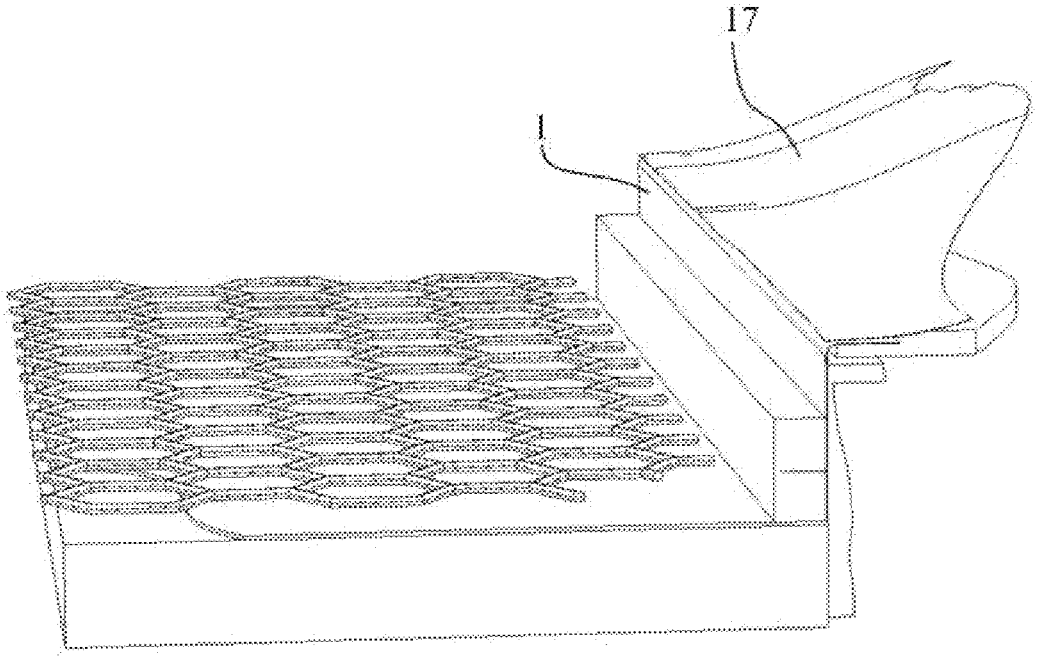
FIG. 6 shows the invention in use securing protective window masking material.

FIG. 6 shows Masking Material 17 applied to exposed Adhesive Tape Strip 1. Now Masking Material 17 and Adhesive Tape Strip 1 beneficially offer substantial protection of any covered surfaces such as windows or doors without need for a separate masking tape application process. This is a fundamental element of the Invention's novelty. The Invention is designed to work in conjunction with Masking Material 17 but does not require its use. Further, Masking Material 17 is typically available as a commercial product and is not included in the Invention.

Figure 7:
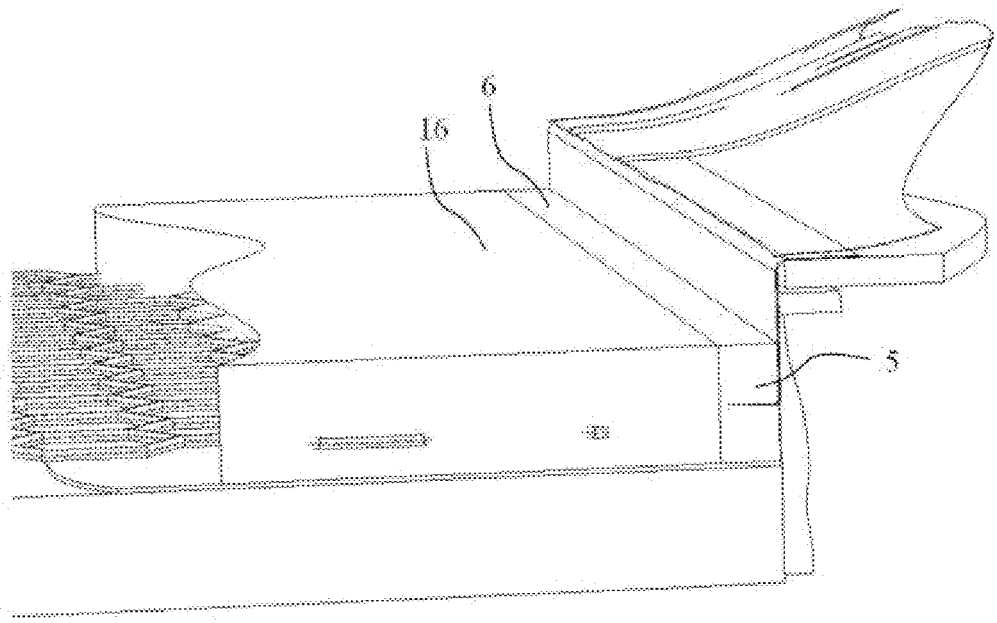
FIG. 7 shows stucco applied up to the limits of the invention's screed surface.

FIG. 7 shows Stucco 16 material applied with its outer surface substantially flush with Screed Surface 6 of Compressible Strip 5. Such application is benefited by Screed Surface 6 presenting a guide for proper application depth and smooth finish of Stucco 16.

Figure 8:
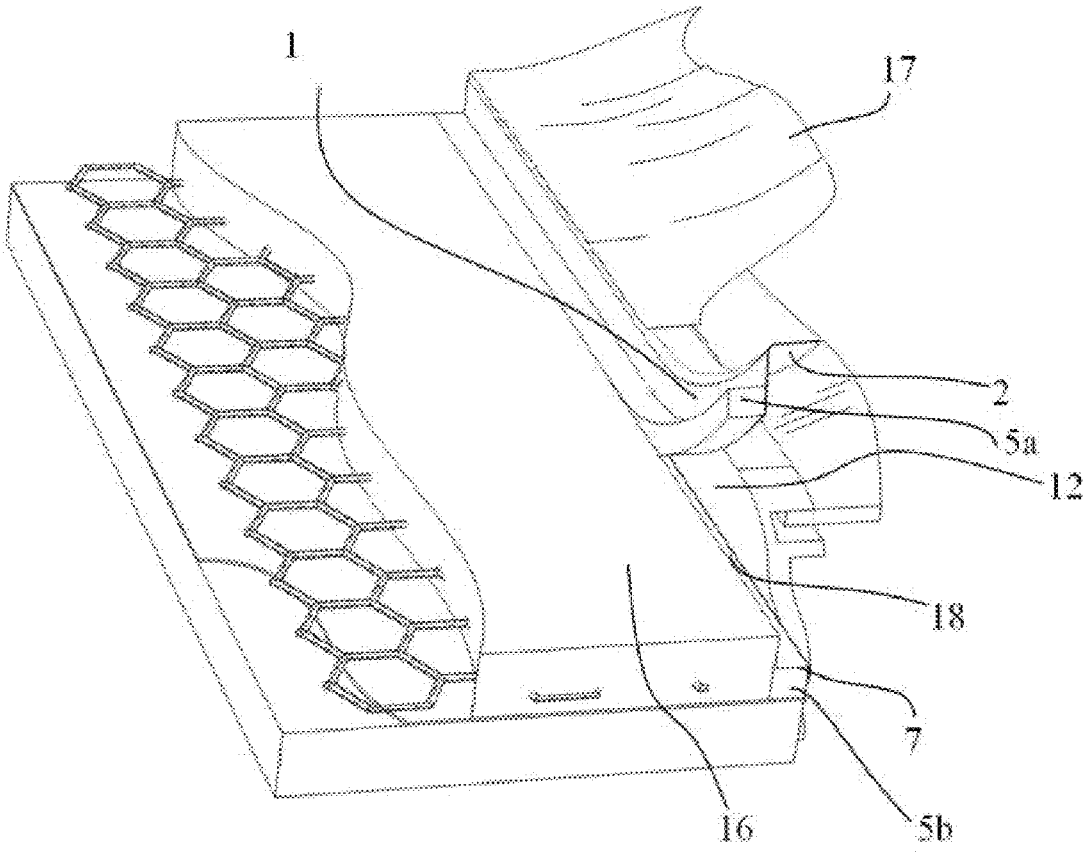
FIG. 8 shows the removal of the upper portion of the invention and attached masking material, thus forming a desirable sealant groove still containing the invention's lower portion as a backing material for later sealant application.

FIG. 8 shows Compressible Strip Upper Portion 5*a*, and the portion of Adhesive Tape Strip 1 above Slit 7, and Back Side Tape Liner Upper Portion 2, and attached Masking Material 17 all being removed in a single operation by stripping them away from Window Frame 12 and Stucco 16, tearing from Compressible Strip Lower Portion 5*b* at Slit 7, and thereby forming a Sealant Slot 18. Compressible Strip Lower Portion 5*b* remains in place, adhered to Window Frame 12 and mechanically engaged with Stucco 16 so as to form a lower surface of Sealant Slot 18, beneficially eliminating the otherwise necessary separate operation of installing a foam backer bar into a sealant slot formed by other means. Sealant Slot 18 may then later be used to apply a flexible sealant in a normal manner known to those in the industry and not a part of this invention.

It is to be understood that the embodiments of the Invention herein described are merely illustrative of the application of the principles of the Invention. Reference herein to details of the illustrated embodiments is not intended to limit the scope of the claims, which themselves recite those features regarded as essential to the Invention. Nor should illustrative mention of windows or doors in the descriptions imply limited use for the Invention, as it may just as well be applied to other joints between building elements or concrete sections where expansion joint function is needed.

What is claimed is:

1. A joint device suitable for use in forming a sealed joint, the device comprising:

an adhesive tape strip with a substantially rectangular cross section with a first adhesive coated surface and a second opposing adhesive coated surface;

an elongate compressible strip adhesively attached to the first adhesive coated surface of the adhesive tape strip adjacent to one edge of the first adhesive coated surface, and covering only a portion of the first adhesive coated surface;

a first adhesive resistant liner removably covering the remaining portion of the first adhesive coated surface;

a slit partially separating an upper portion of the compressible strip and the adhesive tape from a lower portion of each a second flexible adhesive resistant liner removably covering the portion of the second adhesive coated surface of the adhesive tape on a first side of said slit; and a third flexible adhesive resistant liner removably covering the portion of the second adhesive coated surface of the adhesive tape on a second side of the slit.

2. A joint device as in claim 1 where said slit is a cut through the adhesive tape and more than half of the thickness of the compressible strip.

3. A joint device as in claim 1 where said slit is a row of perforation cuts through the compressible strip and the adhesive tape.

4. A joint device as in claim 1 where said compressible strip is a cellular foam material.

5. A joint device as in claim 1 where one surface of the said compressible strip forms a screed surface for application of stucco.

6. A joint device as in claim 1 where removal of the first adhesive resistant liner exposes an adhesive surface for the attachment of adjacent masking materials.

* * * * *